US008242961B2

(12) United States Patent
Liu

(10) Patent No.: US 8,242,961 B2
(45) Date of Patent: Aug. 14, 2012

(54) UWB ANTENNA AND PORTABLE WIRELESS COMMUNICATION DEVICE USING THE SAME

(75) Inventor: Chang-Ming Liu, Tu-Cheng (TW)

(73) Assignee: Chi Mei Communication Systems, Inc, Tu-Cheng, New Taipei (TW)

( * ) Notice: Subject to any disclaimer, the term of this patent is extended or adjusted under 35 U.S.C. 154(b) by 480 days.

(21) Appl. No.: 12/493,340

(22) Filed: Jun. 29, 2009

(65) Prior Publication Data

US 2010/0231463 A1 Sep. 16, 2010

(30) Foreign Application Priority Data

Mar. 13, 2009 (CN) ..... 2009 1 0300864.4

(51) Int. Cl.
*H01Q 1/38* (2006.01)
*H01Q 1/24* (2006.01)

(52) U.S. Cl. ..... 343/700 MS; 343/846

(58) Field of Classification Search ..... 343/700 MS, 343/702, 846

See application file for complete search history.

(56) References Cited

U.S. PATENT DOCUMENTS 7,173,566 B2 * 2/2007 Cheng ..... 343/700 MS
7,495,618 B2 * 2/2009 Kurashima et al. .... 343/700 MS
7,639,186 B2 * 12/2009 Chang ..... 343/700 MS

FOREIGN PATENT DOCUMENTS

WO WO 2007144382 A1 * 12/2007

* cited by examiner

*Primary Examiner* — Hoang V Nguyen
*Assistant Examiner* — Amal Patel
(74) *Attorney, Agent, or Firm* — Altis Law Group, Inc.

(57) ABSTRACT

A UWB antenna mounted on a baseboard includes a first surface and a second surface opposite to the first surface, and a radiating unit, two connecting portions, a mircostrip line, and a grounding unit. The radiating unit includes two radiating bodies positioned on the first surface and the second surface separately. The mircostrip line and the grounding unit are positioned on the first surface and the second surface separately, and connected to the two radiating bodies via the two connecting portions. Projections of the two radiating bodies on the baseboard are symmetrical, and take the connecting portion as an axis.

13 Claims, 7 Drawing Sheets

UWB ANTENNA AND PORTABLE WIRELESS COMMUNICATION DEVICE USING THE SAME

BACKGROUND

1. Technical Field

The disclosure relates to a UWB (Ultra Wideband) antenna and a portable wireless communication device using the UWB band antenna.

2. Description of Related Art

With developments in wireless communication and information processing technologies, wireless home network devices such as notebooks and wireless routers are now in widespread use, with the amount of information transmitted thereamong increasing. Typical short-range communication technologies such as Bluetooth and IEEE 802.11/a/g may not be able to satisfy requirements of quality with inherent low transmission speed and susceptibility to interference. UWB communication technology provides high transmission quality via narrow pulse signals rather than carrier waves, with the added advantage of low power consumption.

Conventional UWB antennas are, however, usually monopole and dipole antennas occupying considerable space within the portable wireless communication devices.

Therefore, there is room for improvement within the art.

BRIEF DESCRIPTION OF THE DRAWINGS

Many aspects of the UWB antenna and portable wireless communication device can be better understood with reference to the following drawings. The components in the drawings are not necessarily drawn to scale, the emphasis instead being placed upon clearly illustrating the principles of the UWB antenna and the portable wireless communication device.

DETAILED DESCRIPTION

Figure 1:
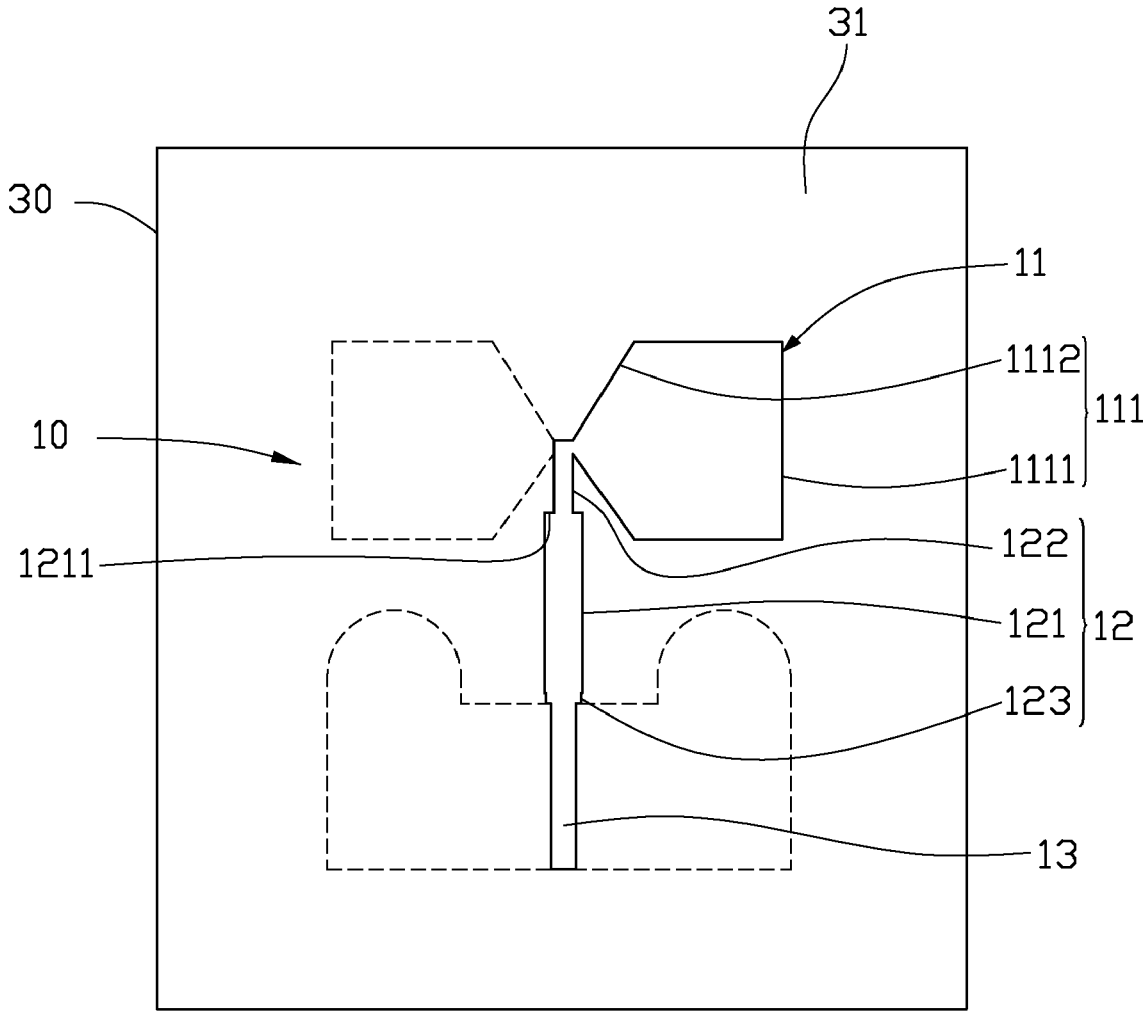
FIG. 1 is a front elevation of a UWB antenna mounted on a baseboard of a portable wireless communication device, according to an exemplary embodiment.
Figure 2:
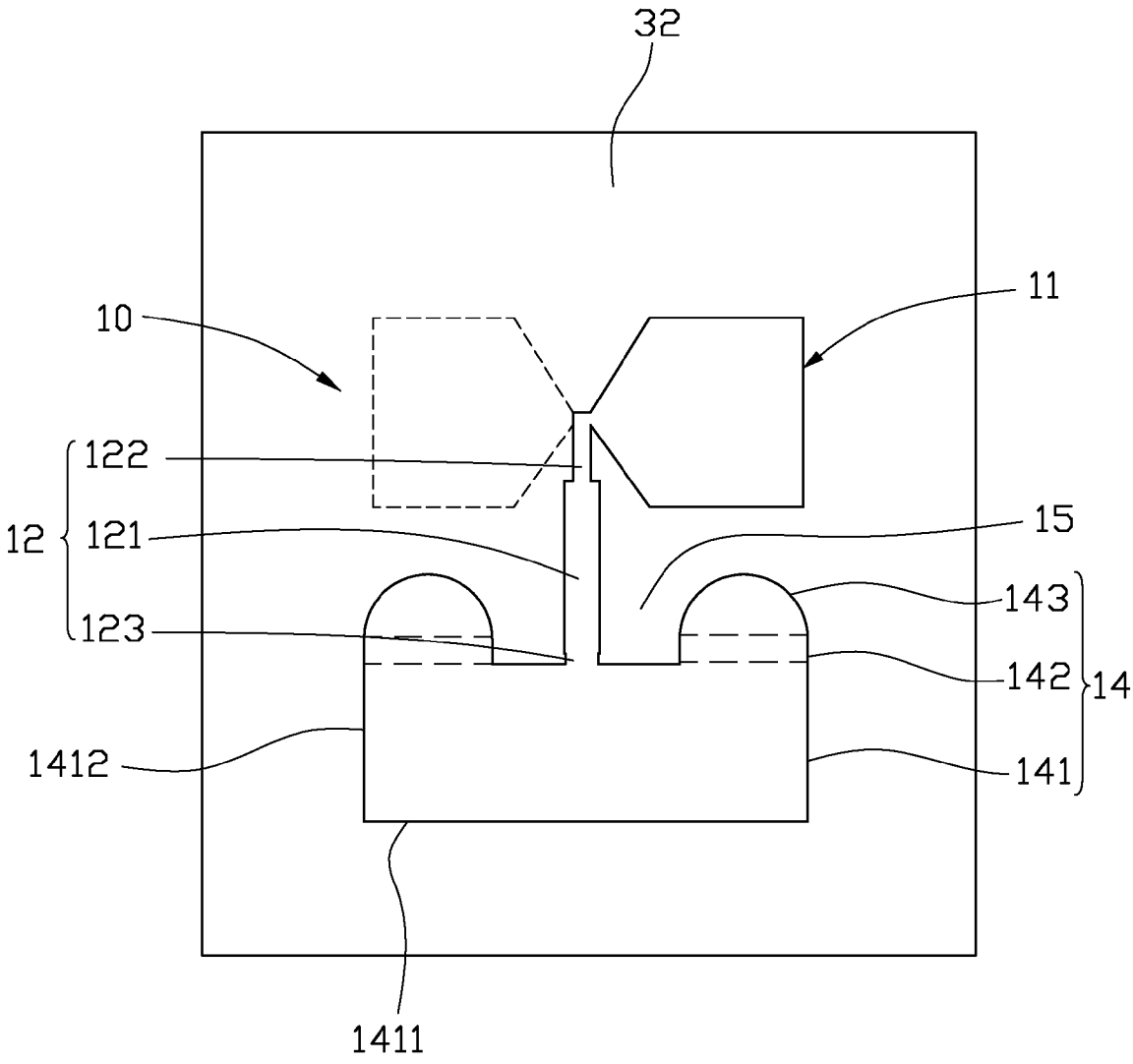
FIG. 2 is a rear elevation of a UMB antenna mounted on the baseboard of a portable wireless communication device.

Referring to FIG. 1 and FIG. 2, a UWB antenna 10 is a double-sided printed antenna mounted on a baseboard 30 of a portable electronic device (not shown), such as a mobile phone or a PDA, to receive and/or transmit wireless signals.

The baseboard 30 is a rectangular printed circuit board including a first surface 31 and a second surface 32 opposite to the first surface 31. Here, the relative permittivity and the loss tangent of the baseboard 30 are about 3.38 and about 0.0025, and the thickness of the baseboard 30 is about 0.06 inch.

The UWB antenna 10 includes a radiating unit 11, two connecting portions 12, a microstrip line 13 and a grounding unit 14. The radiating unit 11 includes two radiating bodies 111 mounted separately on the first surface 31 and the second surface 32. Each radiating body 111 includes a rectangular radiating portion 1111 and an isosceles triangular radiating portion 1112, a base band of which is connected to the rectangular radiating portion 1111. Projections of the two radiating bodies 111 on the baseboard 30 are symmetrical. The two base bands of the two radiating bodies 111 are parallel and the vertical angles of the two radiating bodies 111 have coincident vertices. Thus the two radiating bodies 111 mounted on the first surface 31 and the second surface 32 form an antenna array accessing a wide frequency band radiating performance via the coupling effect generated thereby.

The connecting portion 12 is longitudinal and includes a main body 121, a connecting end 122, and a transmitting end 123. The main body 121 is an approximately rectangular sheet including two ends 1211 opposite to each other. The connecting end 122 and the transmitting end 123 are both rectangular sheets extending from the two ends 1211 of the main body 121 separately. The connecting end 122 and the transmitting end 123 are narrower than the main body 121. The two connecting portions 12 of the UWB antenna 10 are mounted on the first surface 31 and second surface 32 of the baseboard 30 symmetrically having a coincident projection on the baseboard 30. The two connecting ends 122 are connected to the coincident vertices of the two triangular radiating portions 1112. The two transmitting ends 123 are connected to the microstrip line 13 and the grounding unit 14. Thus the projections of the two radiating bodies 111 on the baseboard 30 are symmetrical, and take the connecting portion 12 as an axis.

The mircostrip line 13 is a rectangular sheet set on the first surface 31 of the baseboard 30, and connected to the transmitting end 123 for transmitting signals. To match the impedance of the feeding wire (not show), the width of the mircostrip 13 is chosen to make itself obtain a characteristic impedance of 50Ω.

The grounding unit 14 is positioned on the second surface 32 of the baseboard 30 including a main grounding portion 141, two first minor grounding portions 142, and two second minor grounding portions 143. The main grounding portion 141 is a rectangular sheet including two first band sections 1411 and two second shorter band sections 1412. The two first minor grounding portions 142 are two rectangular sheets extending from two ends of the first band section 1411 at the side of the main grounding portion 141 adjacent to the radiating unit 11 separately. The second minor grounding portion 143 is a semicircular sheet. The two second minor grounding portions 143 are connected to the two first minor grounding portions 142 and form two slots 15 with the main grounding portion 141 and the connecting portion 12. The resonance frequency of the UWB antenna 10 can be adjusted by changing a dimension of the slots 15.

Figure 3:
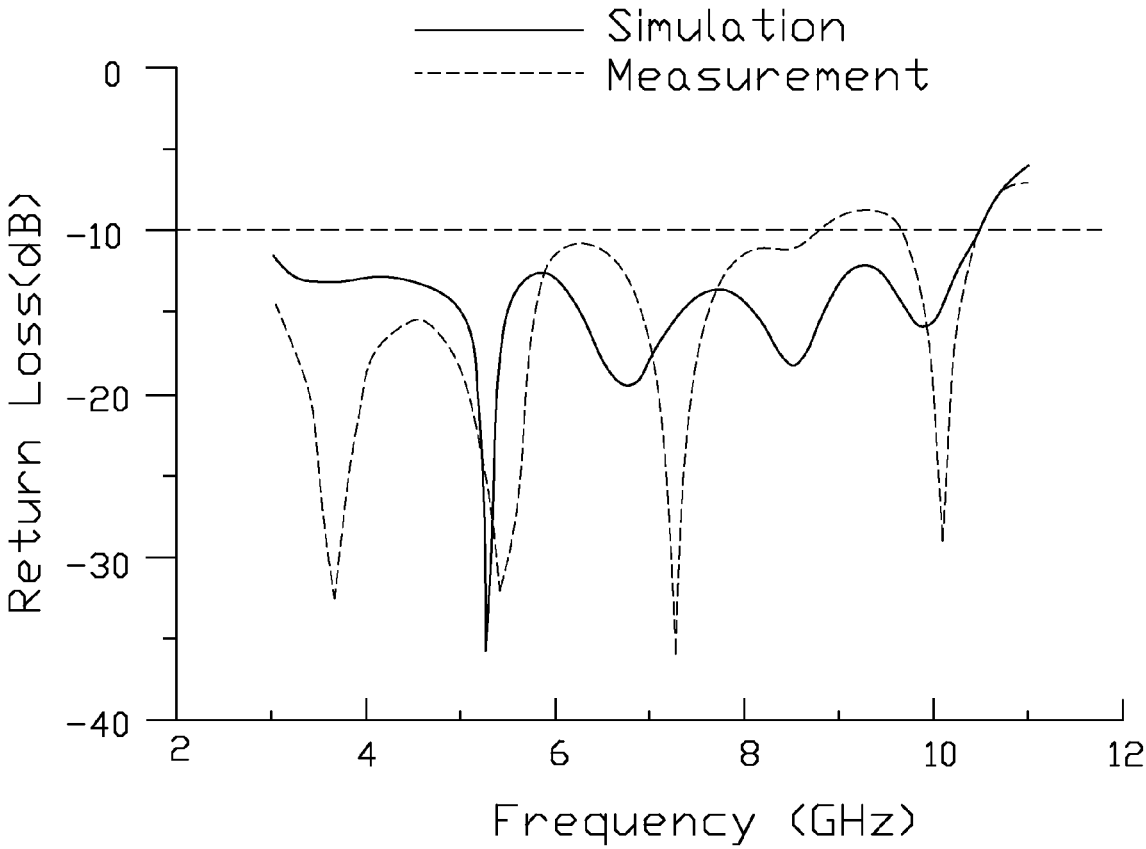
FIG. 3 is an exemplary test graph obtained from the UWB antenna of FIG. 1, disclosing return loss varying with frequency.
Figure 4:
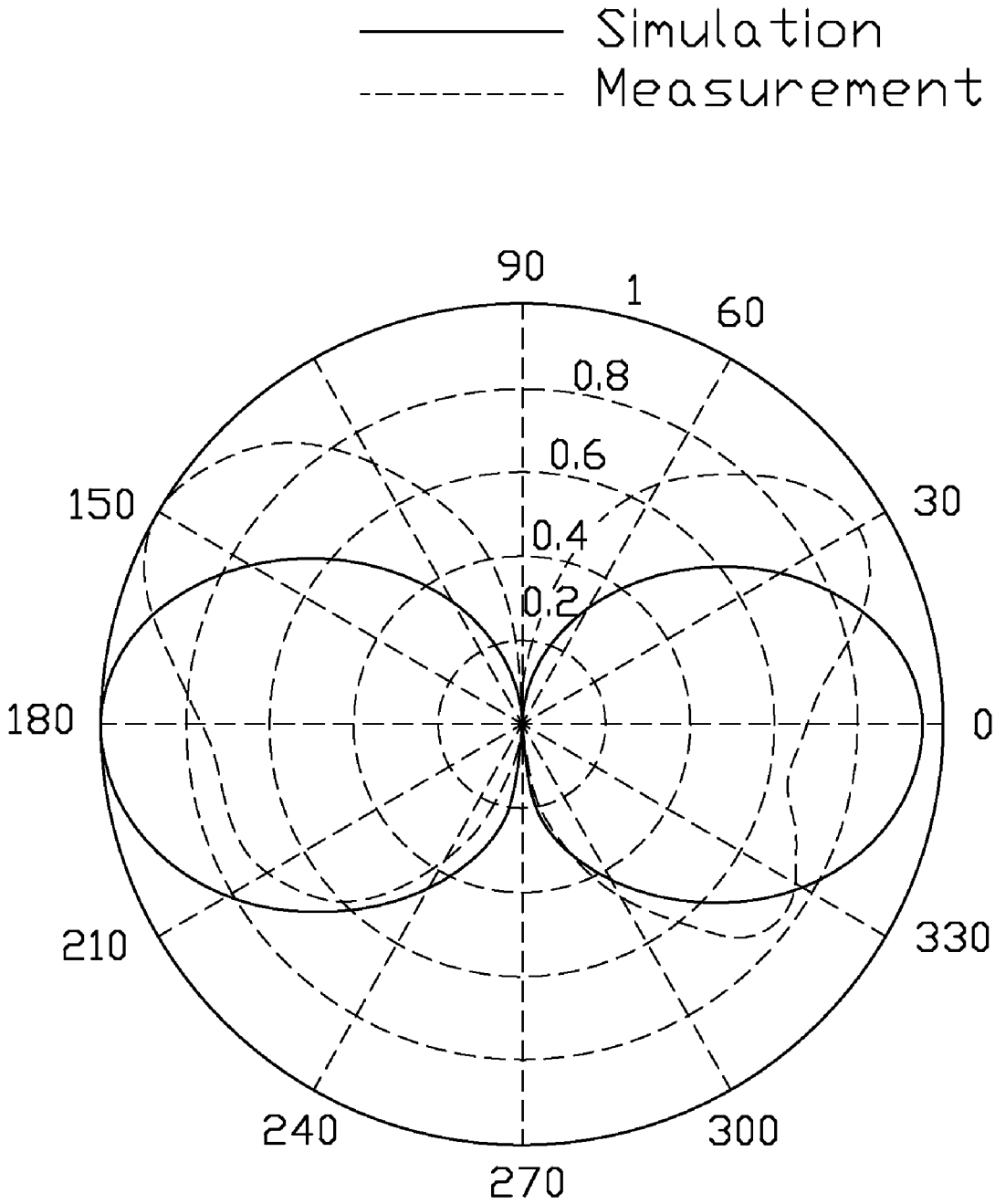
FIG. 4 is an exemplary test graph of radiation pattern obtained from the UWB antenna of FIG. 1 operating at a frequency of about 3.65 GHz.
Figure 5:
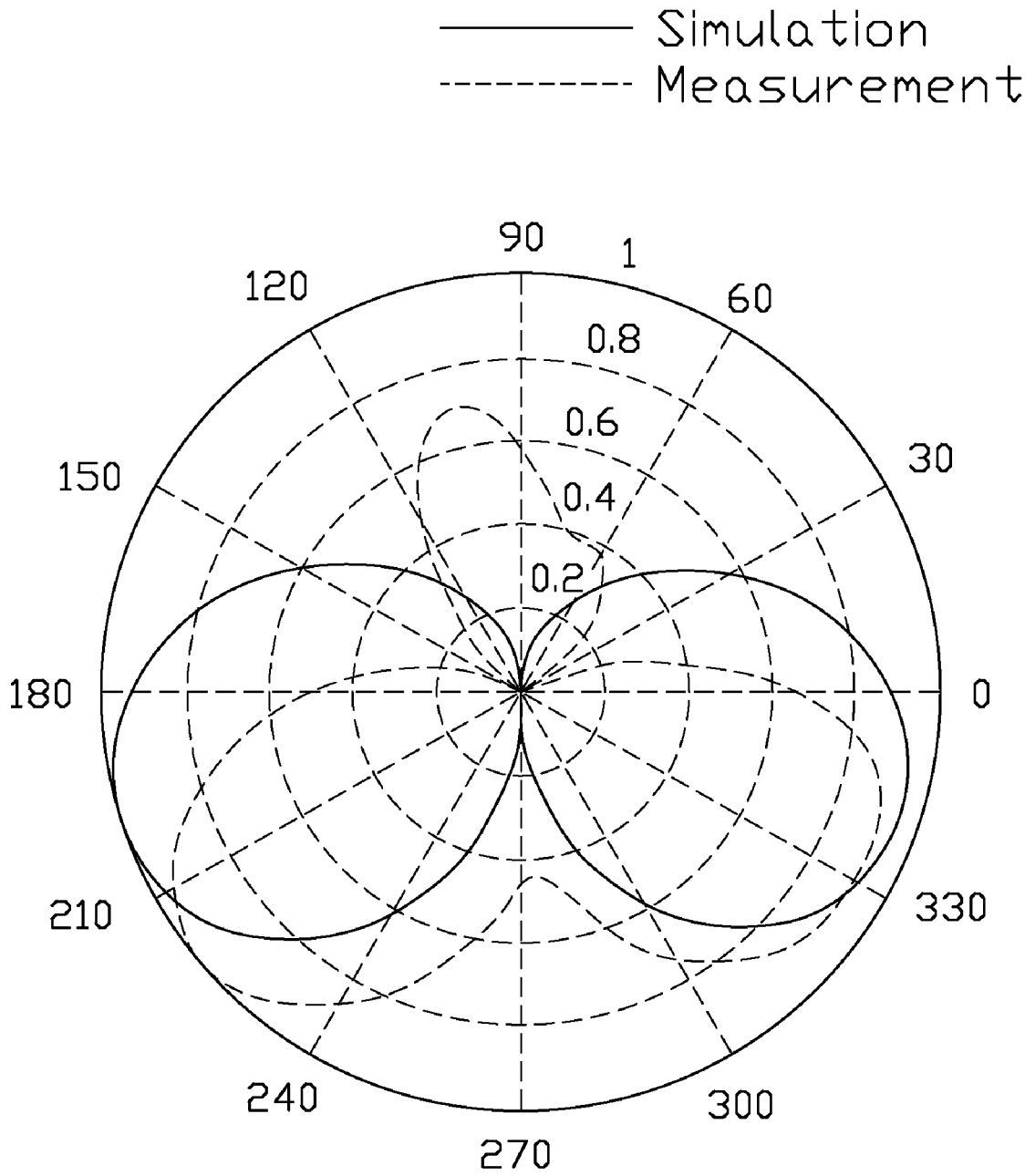
FIG. 5 is an exemplary test graph of radiation pattern obtained from the UWB antenna of FIG. 1 operating at a frequency of about 10.18 GHz.
Figure 6:
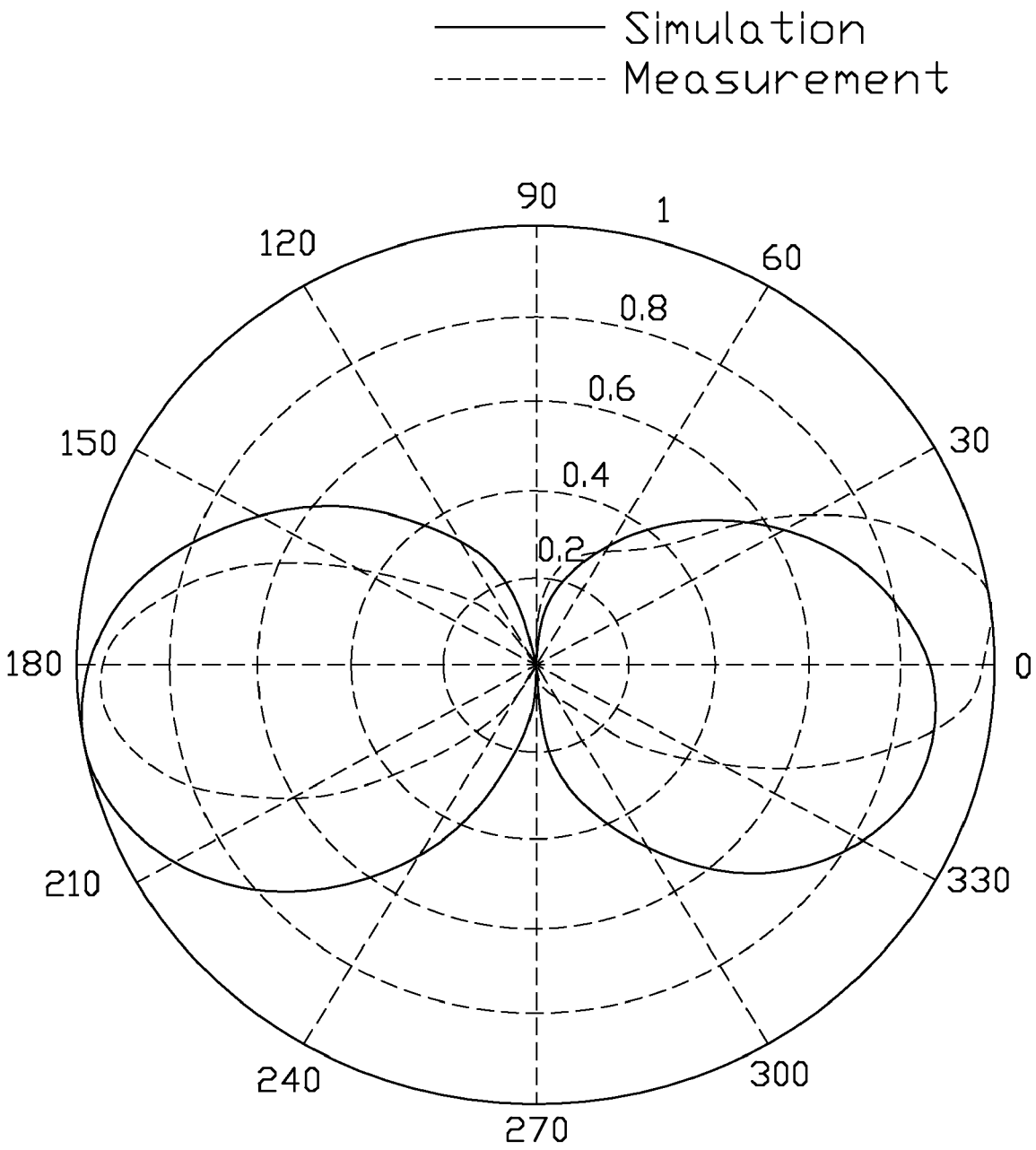
FIG. 6 is an exemplary test graph of radiation pattern obtained from the UWB antenna of FIG. 1 operating at a frequency of about 10.6 GHz.
Figure 7:
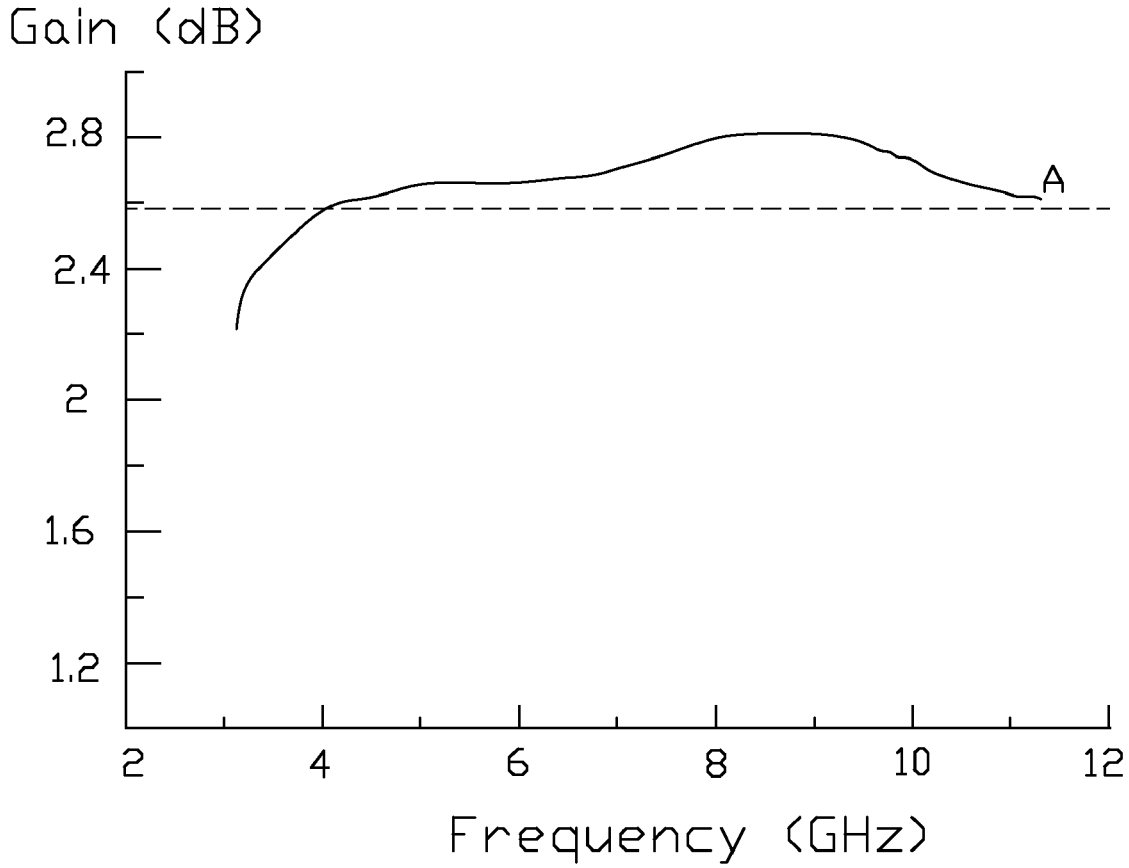
FIG. 7 is an exemplary test graph obtained from the UWB antenna of FIG. 1, disclosing gain varying with frequency.

Referring to FIG. 3, according to test results, the UWB antenna 10 is suitable for operation at frequency bandwidth of 3.1 GHz~10.6 GHz in wireless communication to transmit and receive wireless signals. Referring to FIGS. 4-6, the UWB antenna 10 has improved signal radiating performance at frequency bandwidth of 3.1 GHz~10.6 GHz such as frequencies of 3.65 GHz, 10.18 GHz, and 10.6 GHz. Referring to FIG. 7, the UWB antenna 10 achieves gain flatness of ±3 dB operating at frequency bandwidth of 3.1 GHz~10.6 GHz.

The structure of the UWB antenna 10 is planar, and occupies minimal space within portable wireless communication devices. Furthermore, the UWB antenna 10 obtains a wide frequency bandwidth and a low gain flatness via two radiating bodies 111 set on the first surface 31 and the second surface 32 of the baseboard 30.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A UWB antenna mounted on a baseboard, the baseboard including a first surface and a second surface opposite to the first surface, the UWB antenna comprising:

a radiating unit including two radiating bodies mounted on the first surface and the second surface;

two connecting portions respectively mounted on the first surface and the second surface;

a microstrip line; and a grounding unit, wherein the microstrip line and the grounding unit are respectively mounted on the first surface and the second surface, and respectively connected to the two radiating bodies via the two connecting portions, and wherein a projection of the radiating body mounted on the first surface on the second surface is symmetrical to the radiating body mounted on the second surface, either of the two connecting portions are an axis of symmetry between the projection of the radiating body mounted on the first surface on the second surface and the radiating body mounted on the second surface;

wherein the grounding unit includes a rectangular main grounding portion set on the second surface of the baseboard, connected to the radiating body mounted on the second surface via the connecting portion mounted on the second surface;

wherein the grounding unit includes two first minor grounding portions and two second minor grounding portions, the two second minor grounding portions connected to the two first minor grounding portions and forming two slots with the main grounding portion, the two first minor grounding portions, and the connecting portion mounted on the second surface.

2. The UWB antenna as claimed in claim 1, wherein the radiating body includes a rectangular radiating portion and an isosceles triangular radiating portion connected to the rectangular radiating portion.

3. A portable wireless communication device comprising:

a baseboard, the baseboard including a first surface and a second surface opposite to the first surface;

a UWB antenna mounted on the baseboard; the UWB antenna comprising:

a radiating unit including two radiating bodies respectively mounted on the first surface and the second surface;

two connecting portions respectively mounted on the first surface and the second surface;

a microstrip line; and a grounding unit, wherein the microstrip line and the grounding unit are respectively mounted on the first surface and the second surface, and respectively connected to the two radiating bodies via the two connecting portions, and wherein a projection of the radiating body mounted on the first surface on the second surface is symmetrical to the radiating body mounted on the second surface, either of the two connecting portions are an axis of symmetry between the projection of the radiating body mounted on the first surface on the second surface and the radiating body mounted on the second surface;

wherein the radiating body includes a rectangular radiating portion and a triangular radiating portion connected to the rectangular radiating portion;

wherein the grounding unit includes a rectangular main grounding portion set on the second surface of the baseboard, connected to the radiating body mounted on the second surface via the connecting portion mounted on the second surface; and wherein the grounding unit includes two first minor grounding portions and two second minor grounding portions, the two second minor grounding portions connected to the two first minor grounding portions and forming two slots with the main grounding portion, the two first minor grounding portions and the connecting portion mounted on the second surface.

4. The UWB antenna as claimed in claim 1, wherein each of the radiating bodies includes a rectangular radiating portion and an isosceles triangular radiating portion, and a bottom side of the isosceles triangular radiating portion coincides with a side edge of the rectangular radiating portion.

5. The UWB antenna as claimed in claim 4, wherein a projection of the isosceles triangular radiating portion of the radiating body mounted on the first surface on the second surface, and the isosceles triangular radiating portion of the radiating body mounted on the second surface, are both positioned between a projection of the rectangular radiating portion of the radiating body mounted on the first surface on the second surface, and the rectangular radiating portion of the radiating body mounted on the second surface; and a vertex of the projection of the isosceles triangular radiating portion of the radiating body mounted on the first surface on the second surface and a vertex of the isosceles triangular radiating portion of the radiating body mounted on the second surface are aligned with each other, such that the projection of the isosceles triangular radiating portion of the radiating body mounted on the first surface on the second surface and the isosceles triangular radiating portion of the radiating body mounted on the second surface form a bow-tie shape.

6. The UWB antenna as claimed in claim 1, wherein the two first minor grounding portions are rectangular sheets respectively connected to two ends of a side edge of the main grounding portion; and the two second minor grounding portions are semicircular sheets respectively connected to the two first minor grounding portions, a bottom side of each second minor grounding portion coinciding with a side edge of a corresponding first minor grounding portion.

7. The UWB antenna as claimed in claim 6, wherein the connecting portion mounted on the second surface is substantially a straight sheet perpendicularly connected to a middle part of the side edge of the main grounding portion which is connected to the two first minor grounding portions.

8. The UWB antenna as claimed in claim 1, wherein the connecting portion mounted on the first surface is substantially a straight sheet, the microstrip line is substantially a straight sheet formed on the first surface and positioned to be collinear with the connecting portion mounted on the first surface, and a length of the microstrip line is substantially equal to a width of the main grounding portion.

9. The portable wireless communication device as claimed in claim 3, wherein each of the radiating bodies includes a rectangular radiating portion and an isosceles triangular radiating portion, and a bottom side of the isosceles triangular radiating portion coincides with a side edge of the rectangular radiating portion.

10. The portable wireless communication device as claimed in claim 9, wherein a projection of the isosceles triangular radiating portion of the radiating body mounted on the first surface on the second surface, and the isosceles triangular radiating portion of the radiating body mounted on the second surface, are both positioned between a projection of the rectangular radiating portion of the radiating body mounted on the first surface on the second surface, and the rectangular radiating portion of the radiating body mounted on the second surface; and a vertex of the projection of the isosceles triangular radiating portion of the radiating body mounted on the first surface on the second surface and a vertex of the isosceles triangular radiating portion of the radiating body mounted on the second surface are aligned with each other, such that the projection of the isosceles triangular radiating portion of the radiating body mounted on the first surface on the second surface and the isosceles triangular radiating portion of the radiating body mounted on the second surface form a bow-tie shape.

11. The portable wireless communication device as claimed in claim 3, wherein the two first minor grounding portions are rectangular sheets respectively connected to two ends of a side edge of the main grounding portion; and the two second minor grounding portions are semicircular sheets respectively connected to the two first minor grounding portions, a bottom side of each second minor grounding portion coinciding with a side edge of a corresponding first minor grounding portion.

12. The portable wireless communication device as claimed in claim 11, wherein the connecting portion mounted on the second surface is substantially a straight sheet perpendicularly connected to a middle part of the side edge of the main grounding portion which is connected to the two first minor grounding portions.

13. The portable wireless communication device as claimed in claim 3, wherein the connecting portion mounted on the first surface is substantially a straight sheet, the microstrip line is substantially a straight sheet formed on the first surface and positioned to be collinear with the connecting portion mounted on the first surface, and a length of the microstrip line is substantially equal to a width of the main grounding portion.

* * * * *